US005189962A

United States Patent [19]

Iwamura et al.

[11] Patent Number: 5,189,962

[45] Date of Patent: Mar. 2, 1993

[54] AXLE BOX SUSPENSION WITH RESILIENT ELEMENTS ADHERED TO THE MOVABLE COMPONENTS SUCH THAT ALL RELATIVE MOVEMENT BETWEEN THE COMPONENTS OCCURS BY DEFORMATION OF THE RESILIENT ELEMENTS

[75] Inventors: Akira Iwamura; Shuji Akashi, both of Kobe, Japan

[73] Assignee: Kawasaki Jukogyo Kabushiki Kaisha, Kobe, Japan

[21] Appl. No.: 892,713

[22] Filed: May 29, 1992

Related U.S. Application Data

[63] Continuation of Ser. No. 400,425, Aug. 30, 1989, abandoned.

[30] Foreign Application Priority Data

Sep. 1, 1988 [JP] Japan ..... 63-216220

[51] Int. Cl.[5] ..... B61F 5/30

[52] U.S. Cl. ..... 105/218.2; 105/224.05; 105/224.1; 403/225

[58] Field of Search ..... 105/218.1, 218.2, 224.05, 105/224.06, 224.1; 280/664, 717; 403/225, 226, 228

[56] References Cited

U.S. PATENT DOCUMENTS

| | | | |
|---|---|---|---|
| 2,740,622 | 4/1956 | Hickman | 280/717 X |
| 3,337,232 | 8/1967 | Peickii et al. | 403/225 X |
| 4,003,316 | 1/1977 | Monselle | 105/224.06 X |
| 4,294,178 | 10/1981 | Harsy | 105/218.2 X |
| 4,356,775 | 11/1982 | Paton et al. | 105/218.2 |
| 4,619,544 | 10/1986 | Laidley | 403/225 X |
| 4,690,069 | 9/1987 | Willetts | 105/218.2 X |
| 4,690,231 | 9/1987 | Riml | 403/225 X |

FOREIGN PATENT DOCUMENTS

| | | | |
|---|---|---|---|
| 935841 | 9/1963 | United Kingdom | 105/218.2 |

*Primary Examiner*—Robert J. Oberleitner
*Assistant Examiner*—S. Joseph Morano
*Attorney, Agent, or Firm*—Schwartz & Weinrieb

[57] ABSTRACT

There is provided an axle box suspension, having an axle spring, according to the present invention, wherein an axle box body is formed by providing an axle anchor rod at one end of the axle box, and the axle anchor rod is coupled to a truck frame through means of a resilient element, so that longitudinal, lateral and vertical swivel movements between the axle and the truck frame can be achieved by deforming the resilient element and the axle anchor rod without rattling therebetween, whereby the running stability of the vehicle is greatly improved. Furthermore, since the axle box suspension does not have relatively sliding components or gaps defined therebetween, wear and a deterioration due to years of operation are effectively reduced or eliminated, whereby replacement of the components will be obviated and maintenance thereof will be much more facilitated. Moreover, excellent advantages such as for example, simplified structure, space-saving with respect to the entire axle box suspension, and a reduction in its weight are achieved.

18 Claims, 10 Drawing Sheets

AXLE BOX SUSPENSION WITH RESILIENT ELEMENTS ADHERED TO THE MOVABLE COMPONENTS SUCH THAT ALL RELATIVE MOVEMENT BETWEEN THE COMPONENTS OCCURS BY DEFORMATION OF THE RESILIENT ELEMENTS

This application is a continuation of application Ser. No. 07/400,425, filed Aug. 30, 1989 now abandoned.

BACKGROUND OF THE INVENTION

1. Field of the Invention

The present invention relates to an axle box suspension for supporting the axle of a truck by means of an axle anchor rod integrally formed with the axle box and operatively connected to a truck frame of a railway vehicle or car or the like.

2. Description of the Prior Art

An axle anchor rod type axle box suspension for mounting the axle of a railway vehicle upon a truck frame is already disclosed, for example, in Japanese Patent Laid-Open No. 58-63568 and No. 58-118447. FIGS. 10A and 10B show such conventional examples. In the drawings, numeral 13 denotes a wheel, which is mounted upon the same axle as that of a wheel (not shown) provided at the opposite side of the vehicle. Two axles are mounted within the vicinity of both ends of a truck frame 12, thereby constituting one truck. Numeral 3 denotes an axle box which contains a bearing 2 and the like for the axle 1. Extending from the right side of the axle box 3 is an axle anchor rod 3' formed integrally with the axle box and rotatably slidably supported by means of a pin 8', having a resilient element 7a wound therearound, with respect to the truck frame 12. Extending from the left side of the axle box 3 is one end of a link 11 which is connected thereto by means of a pin 10, and the other end of the link 11 is coupled to the truck frame 12 through means of a resilient element 7b. Numeral 6 denotes an axle spring, which buffers relative upward and downward movements between the truck frame 12 and the axle 1.

In accordance with this axle box suspension, the upward and downward vibrations which occur between the truck frame 12 and the wheel 13 are permitted to occur by means of the rotatably sliding pins 8' and 10.

The axle anchor rod type axle box suspension shown in FIGS. 11A and 11B eliminates a sliding section and is seen to include an axle anchor rod 3' which is coupled to a truck frame 12 by means of a pin 8' having a resilient element 7a wound therearound. Since the axle anchor rod 3' comprises a cantilever beam having forked or laterally separated ends, two sets of resilient elements 7a and pins 8' must be provided as shown in FIG. 11B so as to resist any external force applied in the axial direction.

Furthermore, in order to prevent any reduction in the wheel load (or a derailment caused at its final stage of the reduction) due to an external force in the axial direction or an irregularity of the tracks of the rails, a resilient bearing supporting element 7c is annularly interposed between a bearing 2, the axle box 3, and a bearing retainer 5.

The performance required for a modern railway vehicle includes high speed running performance, easiness of maintenance and a reduction in the vehicle weight so as to reduce the amount of damage imposed upon the rails, and the like.

However, as will be appreciated from the conventional example in FIGS. 10A and 10B of the prior art, when the vehicle is coasting, the act of absorbing a vibration in the axial direction of the vehicle is deteriorated due to sliding movements and gaps defined between the pin 8' and the resilient element 7a, between the pin 8' and the truck frame 12, and between the pin 10 and the link 11, so that the running stability of the vehicle is reduced, whereby the running ability at high speed is also greatly reduced. Furthermore, additional problems occur, such as, for example, deterioration in the running performance of the vehicle due to the aging wear of the slide sections and the gap sections and complication in its maintenance due to lubrication and replacement of the components thereof.

On the other hand, in the conventional example shown in FIGS. 11A and 11B, the slides and gaps do not exist within the axle box suspension, but its axle anchor rod is increased in size and in weight, and the space required for mounting the same is increased. Furthermore, as shown in a sectional view of the axle anchor rod 3' in FIG. 12, since the axle anchor rod 3' has a large twisting rigidity in the rotating direction I, (that is, in the running direction) and a large width dimension in the axial direction of the resilient elements 7a, the twisting rigidity between the axle anchor rod 3' and the truck frame 12 is large. Accordingly, it is necessary to in fact provide the resilient element 7c in conjunction with the bearing 2 so as to prevent a reduction of the wheel load (or a derailment) which is possibly caused when the track is twisted due to an irregularity in the track or a reduction in the cant (the difference between the heights of an inside rail and an outside rail along a curve), whereby problems such as, for example, a complicated construction and an increase in the weight of the axle box 3 are caused.

OBJECT OF THE INVENTION

This invention has been developed so as to solve the above-described problems of the prior art, and an object of the invention is to provide a light-weight axle box suspension which has high running stability at high operating speeds and which permits a reduction in its maintenance work.

SUMMARY OF THE INVENTION

In order to achieve the above-described object, there is provided according to one aspect of the present invention an axle box suspension for a railway vehicle comprising an axle anchor rod extending from one side of an axle box, an axle spring interposed between an axle box body and a truck frame, the axle anchor rod being integrally coupled to the truck frame through means of a shaft and a resilient element. As a result, twisting rigidity of the vehicle in the running direction of the vehicle is imposed upon both the axle anchor rod and the resilient element.

There is also provided according to another aspect of the present invention an axle box suspension for a railway vehicle comprising an axle box body having an axle anchor rod integrally formed at one side of an axle box and a supporting arm at the other side of thereof and an axle spring interposed between the axle box body and a truck frame, the axle anchor rod being integrally coupled to the truck frame through means of a first resilient element, the supporting arm being coupled to the truck frame through means of a second resilient element in such a manner that the twisting rigidity of the second resilient element in the running direction of the vehicle is sufficiently smaller than the composite twisting rigidity of the axle anchor rod and the first resilient element in the same direction.

The operation of this invention will be briefly described with reference to FIGS. 1 and 2.

The axle box body 4 is integrally formed so as to comprise the axle box 3 and the axle anchor rod 3', and is mounted upon the truck frame 12 through means of the resilient element 7 in such a manner that there is no sliding movement or gap defined therebetween.

The relative vertical movements between the axle 1 and the truck frame 12, which is equivalent to a swivel movement of the axle box body 4 around the shaft 8, is allowed by means of the deformation of the resilient element 7 provided between the axle anchor rod 3' and the truck frame 12.

Since the axle anchor rod 3' allows a twist or torsion in the running direction of the vehicle, and is coupled in series with the twisting rigidity of the resilient element 7, then the composite twisting rigidity between the axle box body 4 and the truck frame 12 is reduced, whereby the relative rolling displacement between the axle 1 and the truck frame 12 can be easily accommodated, so that the axle box and the axle can follow the longitudinal, lateral and vertical vibrations or movements between the axle and the truck frame as a whole without exhibiting any rattling phenomenon.

BRIEF DESCRIPTION OF THE DRAWINGS

Other objects and features of the invention will be more fully understood from the following detailed description and appended claims when taken in connection with the accompanying drawings, in which like reference characters designate like or corresponding parts throughout the several views, and wherein:

FIGS. 10A and 10B are front and top views of a conventional example of an axle box suspension, wherein FIG. 10A is a front view, and FIG. 10B is a sectional view taken along the line 10B—10B of FIG. 10A;

FIGS. 11A and 11B are views of another conventional example of an axle box suspension, wherein FIG. 11A is a front view, and FIG. 11B is a top view.

DETAILED DESCRIPTION OF THE PREFERRED EMBODIMENTS

There will now be described preferred embodiments of the present invention with reference being made to the drawings.

Figure 1:
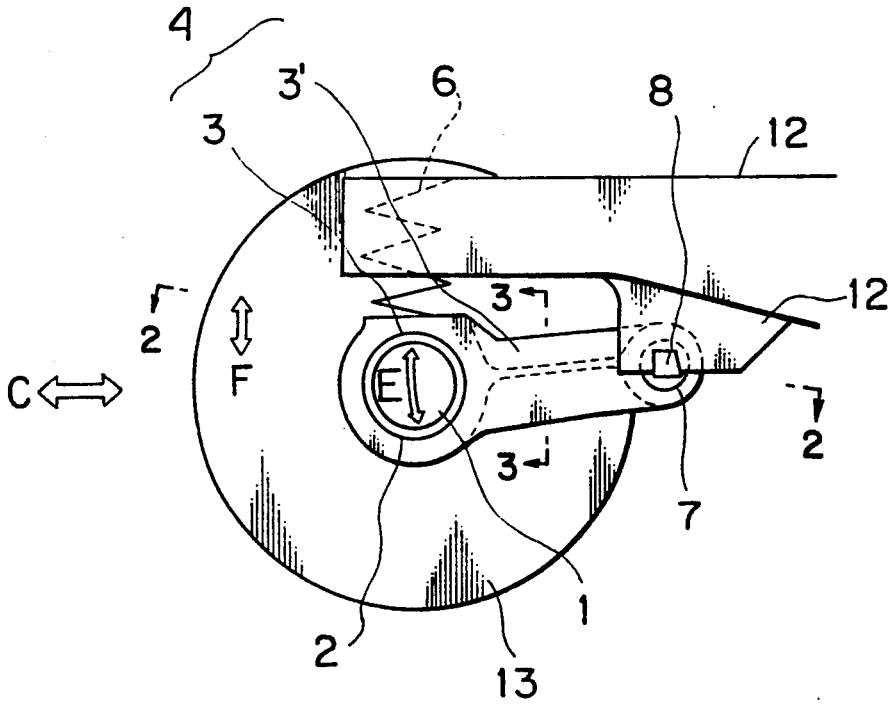
FIG. 1 is a front view of an axle box suspension constructed according to a first embodiment of this invention.
Figure 2:
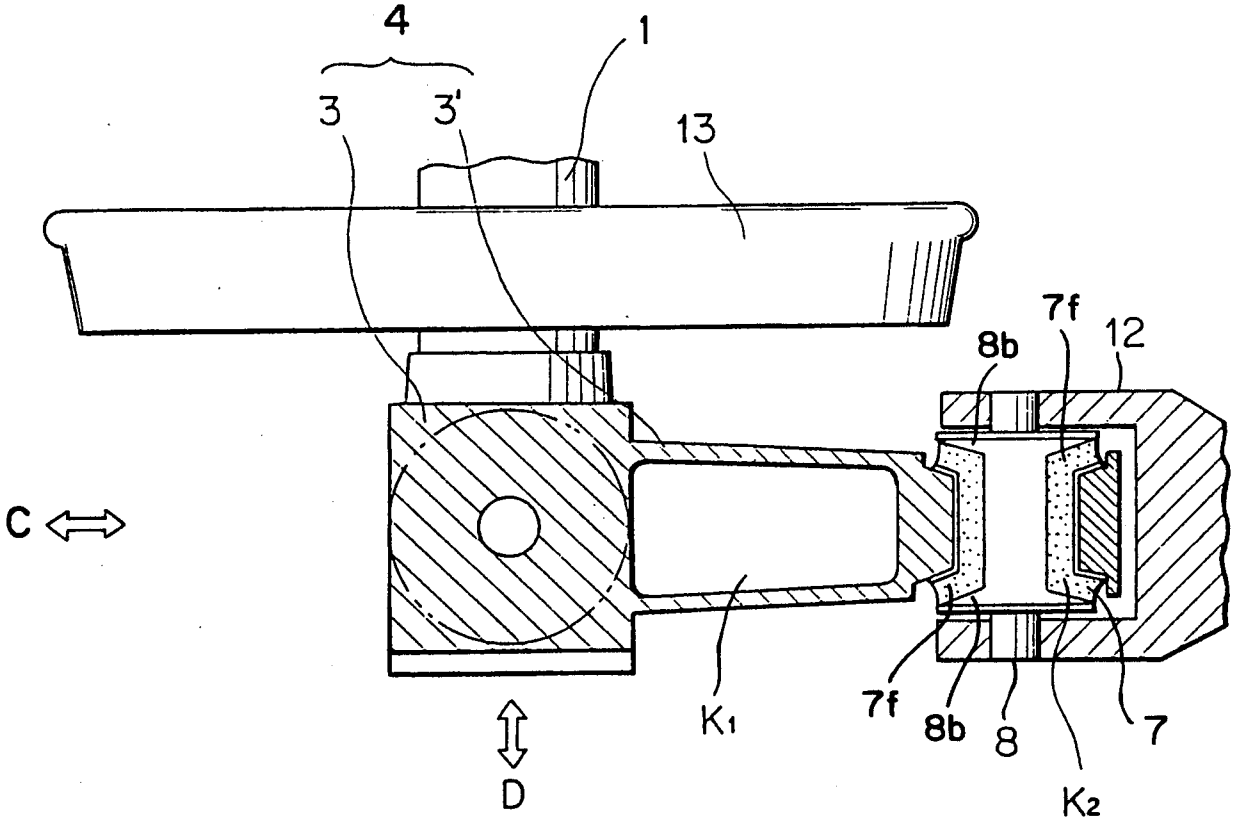
FIG. 2 is a sectional view taken along the line 2—2 of FIG. 1.
Figure 3:
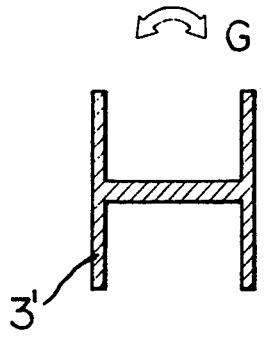
FIG. 3 is a sectional view taken along the line 3—3 of FIGS. 1 or 6.

Referring to FIGS. 1 to 3, an axle anchor rod 3' extending in the same direction as the running direction C of a truck is integrally provided upon an axle box 3, which is supporting the axle 1 which has a wheel 13 mounted thereon, forming an axle box body 4. The axle box body 4 is mounted upon a truck frame 12 through means of an axle spring 6 at one end thereof, and the other end of the axle anchor rod 3' is also coupled by means of a resilient element 7 and a shaft 8 to another portion of the truck frame 12.

The resilient element 7 is adhered to the shaft 8 and is force-fitted into the noted end of the axle anchor rod 3', so that there is no slipping or relatively movable part in this structure. The shaft 8 and the truck frame 12 are coupled together by means of a tapered shaft fitting or a bolt clamping, which also provides the structure with no slipping or relatively movable parts. Accordingly, the axle box body 4 is allowed to swivel in a direction E around the shaft 8 as a center by means of the deformation of the resilient element 7. Thus, the axle 1 is allowed to move through relative vertical movements in a direction with respect to the truck frame 12 through means of the axle box body 4.

The resilient element 7 transmits a propulsion force and a brake force in the direction C (same as the running direction) and a lateral force in a direction D (same as the axial direction) from the axle 1 to the truck frame 12 through means of the axle box 3 and the axle anchor rod 3'. As best seen in FIG. 3, the latter force transmission is particularly accomplished as a result of the complementary, fixed, tight mating of opposite bobbin portions 8*b* of the shaft 8 and opposite flange portions 7*f* of the resilient element 7.

As described above, a displacement between the axle box body 4 and the truck frame 12 is allowed by means of the deformation of the resilient element 7. Since there is no slippage and particularly no existing gap in the direction C (same as the running direction of the vehicle), the axle box suspension does not rattle, so that running stability is enhanced and the vehicle is enabled to run at high speed. Furthermore, since there is no relative sliding or slipping parts, the gap is not increased due to aging wear as with the conventional suspension, and the deterioration of the running performance can be prevented, so that the replacement of worn components is rendered unnecessary, and maintenance can be easily accomplished. As compared with the conventional suspension, the link and the pins are eliminated, whereby the weight of the axle box suspension can be reduced. Furthermore, the suspension is easy to assemble because of its simple structure.

In the present invention, since the twisting rigidity of the resilient element 7 can be coupled in series with that of the axle anchor rod 3', the twisting rigidity between the axle box body 4 and the truck frame 12 can be reduced.

FIG. 3 is a sectional view of the axle anchor rod 3'. When the twisting rigidity of the axle anchor rod 3'' in a direction G (circumferentially about the running direction) is designated by K1 as shown in FIG. 2 and the twisting rigidity of the resilient element 7 in the direction G is designated by K2, the composite twisting rigidity K of the axle anchor rod 3' and the resilient element 7 is obtained from the formula $1/K=1/K1+1/K2$, and thus the combined twisting rigidity is smaller than K1 or K2.

Furthermore, the twisting rigidities K1 and the K2 are substantially designed to have the same value, thereby reducing the composite twisting rigidity K of the rigidities K1 and K2 with good balance without decreasing the strengths of the axle anchor rod 3' and the resilient element 7. As a result, relative displacement is allowed in the rolling direction between the axle 1 and the truck frame 12. Therefore, the vehicle can follow any twists of the track due to an irregularity in the track or a reduction in the cant of the rails, thereby preventing a reduction of the wheel load generated by means of the twist of the rails so as to, in turn, prevent derailment. If a reduction of the wheel load is not reduced or is permitted to be increased, derailment will occur.

Figure 4:
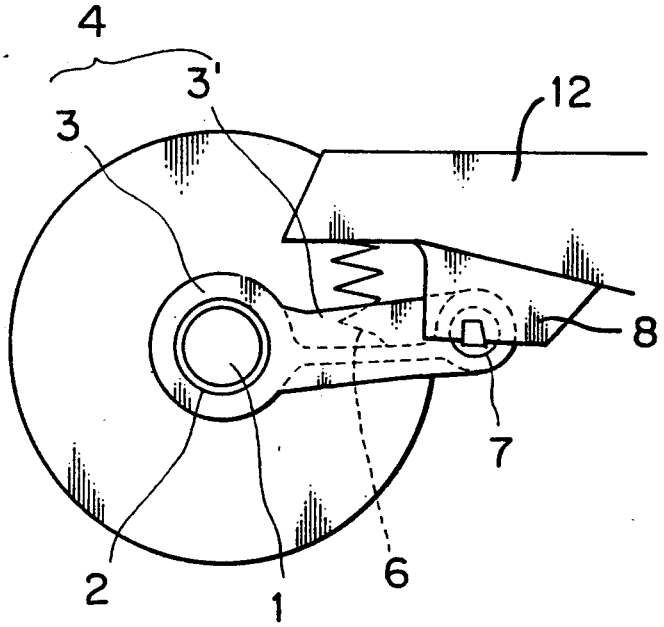
FIG. 4 is a front view of an axle box suspension constructed according to a second embodiment of this invention.

FIG. 4 shows a second embodiment of the invention. An axle spring 6 is interposed between a truck frame 12 and an axle anchor rod 3'. The other structure of the suspension is the same as that of the previous embodiment.

The twisting rigidity of the axle anchor rod 3' is suitably selected by predetermining its sectional shape in combination with the twisting rigidity of the resilient element 7.

Figure 5A:
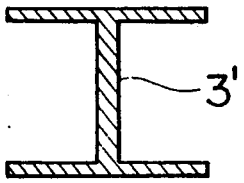
FIGS. 5A and 5B are sectional views showing modified examples of the sectional shape of an axle anchor rod.
Figure 5B:
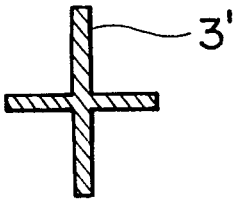

FIGS. 5A and 5B show other examples of the sectional configurations of the axle anchor rod 3'. Thus, the twisting rigidity of the axle anchor rod 3' in a direction G in FIG. 3 can be selected by suitably predetermining or selecting the sectional shape of the axle anchor rod 3' as described above.

Figure 6:
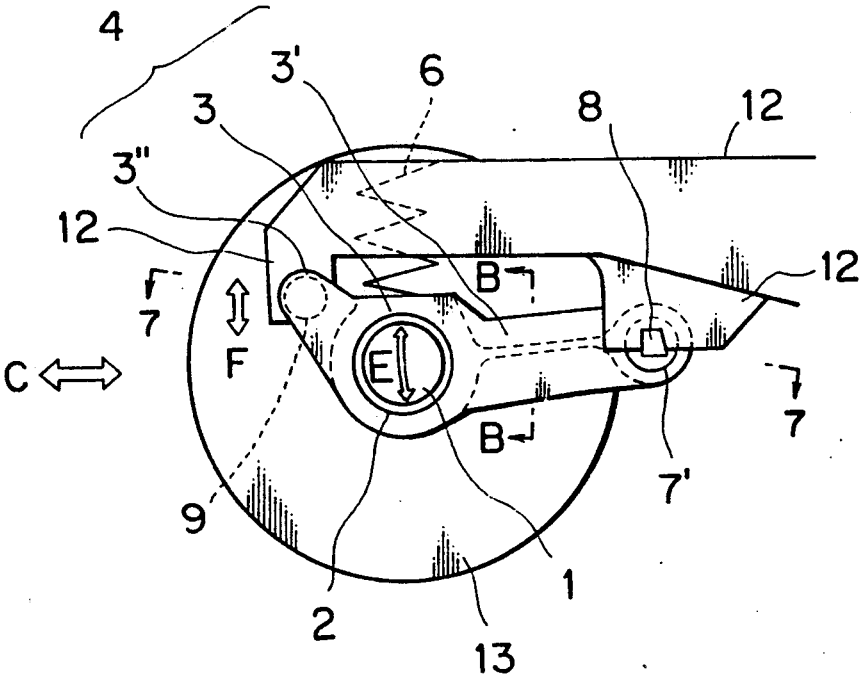
FIG. 6 is a front view of the first embodiment of the invention, wherein a second resilient element is incorporated within the system.
Figure 7:
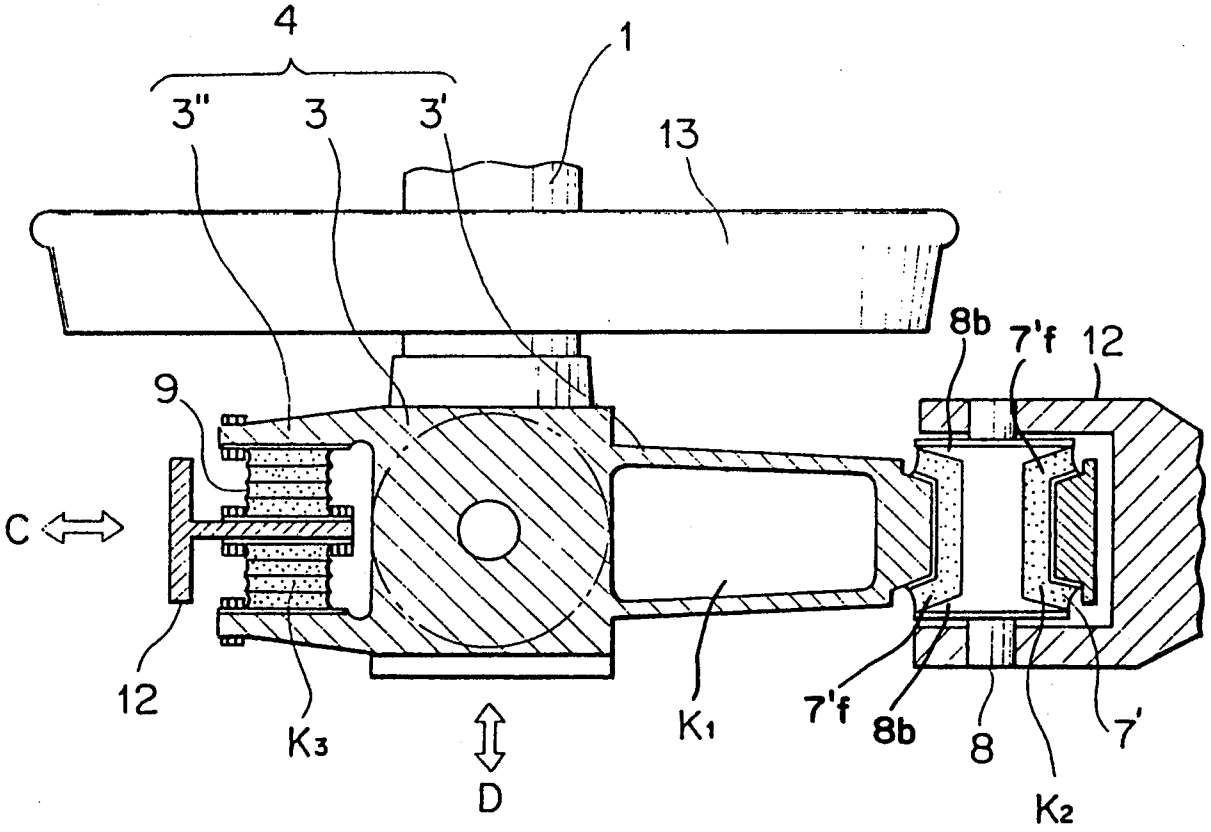
FIG. 7 is a sectional view taken along the line 7—7 of FIG. 6.

FIGS. 6 and 7 show another embodiment of the invention. The axle box of the embodiment as shown in FIG. 1 and FIG. 2 is of the cantilever type, whereas the axle box of this embodiment is provided with a second resilient element 9. An axle box 3 supporting the axle 1 with a wheel 13 therein is provided with an axle anchor rod 3' and a supporting arm 3'' extending longitudinally in the running direction C of the truck so as to form an axle box body 4. The axle anchor rod 3' is coupled to an axle anchor rod supporting portion of the truck frame 12 by means of a first resilient element 7' and a shaft 8, and the supporting arm 3'' is coupled to a second supporting portion of the truck 12 in such a manner that two second resilient elements 9 are held therebetween.

The first resilient element 7' is adhered to the shaft 8, while the second resilient element 9 is formed as a laminated layer structure so that the rigidity thereof in a direction F corresponding to a shearing direction may be reduced. Thus, the axle 1 is allowed to undergo relative vertical movement in the direction E in the drawings with respect to the truck frame through means of the axle box body 4.

The first resilient element 7' transmits a propulsion force and a brake force in the direction C (same as the running direction of the vehicle) and a lateral direction force of in the direction D (same as the axial direction) from the axle 1 to the truck frame 12 through means of the axle box 3 and the axle anchor rod 3', as a result of the interengaging and complementary bobbin portions 8*b* of shaft 8 and the flange portions 7'*f* of the resilient element 7' in a manner similar to that of the embodiment of FIG. 2, while the second resilient element 9 primarily transmits the lateral force in the direction D.

Since the second resilient element 9 is formed as a laminated layer structure, it can resist forces applied in the direction D, and rigidity in the vertical direction is smaller than that of the axle spring 6 in the direction F.

In this embodiment, since the twisting rigidities of the first resilient element 7' and the axle anchor rod 3' are coupled in series, the composite twisting rigidity K of the axle anchor rod 3' and the first resilient element 7' is obtained from the formula $1/K=1/K1+1/K2$, and the composite twisting rigidity is reduced to a value which is smaller than K1 and K2.

The twisting rigidity of the second resilient element 9 supported by the supporting arm 3'' at the other end of the axle box body 4 is dynamically disposed in parallel with the composite twisting rigidity K. When this twisting rigidity is designated by K3, the total twisting rigidity between the axle box body 4 and the truck frame 12, that is, the total twisting rigidity Kt between the axle 1 and the truck frame 12 becomes $Kt=K+K3$. Since the relation $K>>K3$ can be obtained by forming the structure of the second resilient element as a laminated layer structure, the twisting rigidity K3 can be ignored, so that the total twisting rigidity Kt between the axle 1 and the truck frame 12 becomes $Kt=K$, and the influence of the second resilient element 9 upon the entire twisting rigidity is reduced so as to be very small.

As described above, even in this embodiment, the composite twisting rigidity can be reduced.

Figure 8:
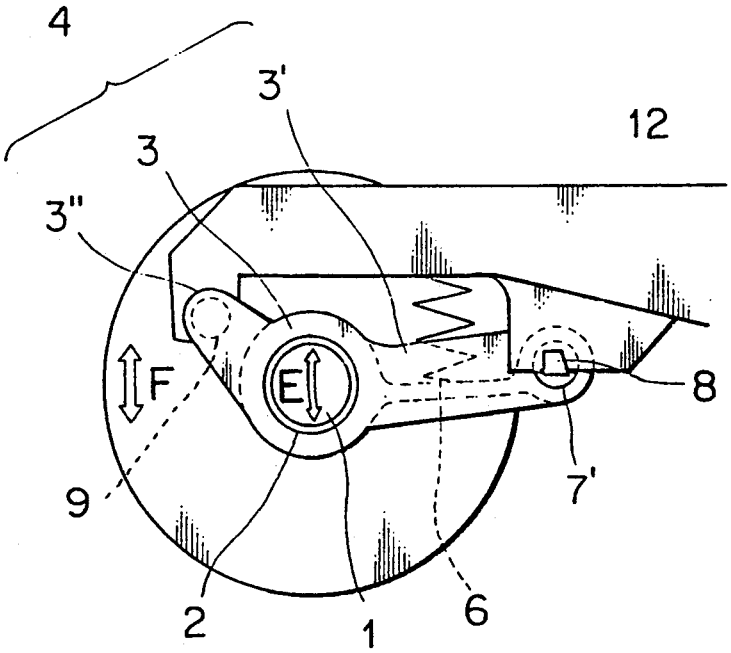
FIG. 8 is a front view of the second embodiment of the invention, wherein the second resilient element is incorporated therein.

FIG. 8 shows the second embodiment of the invention, wherein the second resilient element is incorporated. In this embodiment, the axle spring 6 is interposed between a different portion of the truck frame 12 and the axle anchor rod 3'. The other structure is the same as that of the embodiment shown in FIG. 6.

Figure 9:
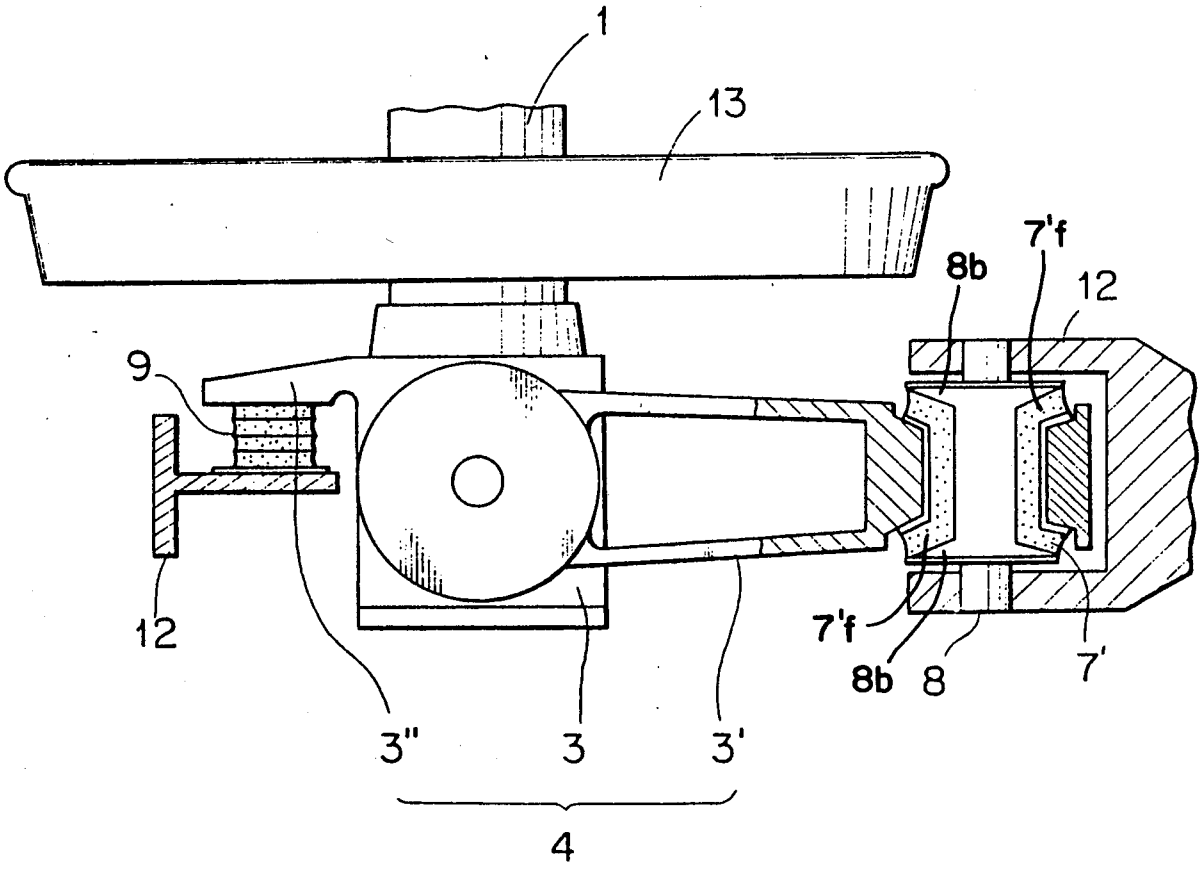
FIG. 9 is a top view of a third embodiment of the invention, wherein the second resilient element is incorporated therein.
Figure 10A:
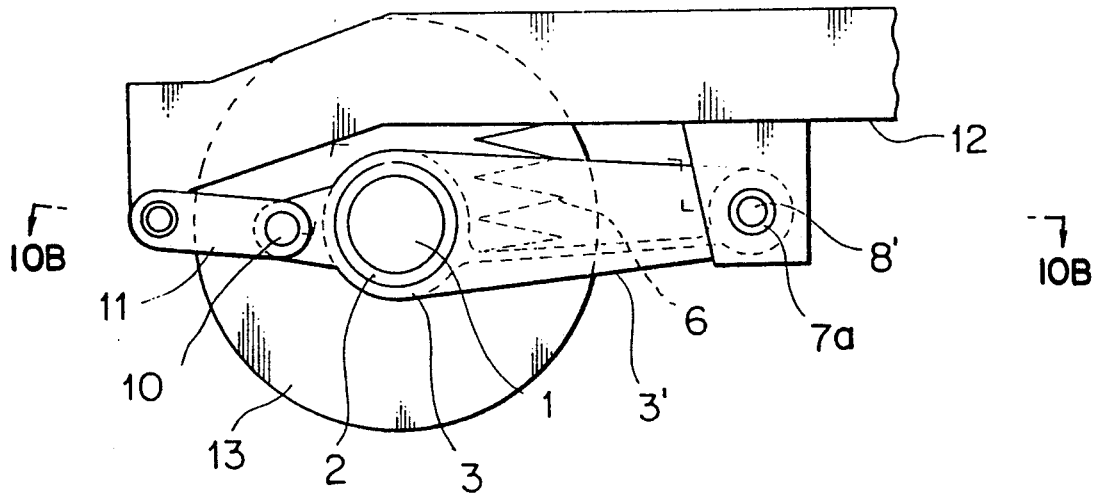
FIG. 10A PRIOR ART
Figure 10B:
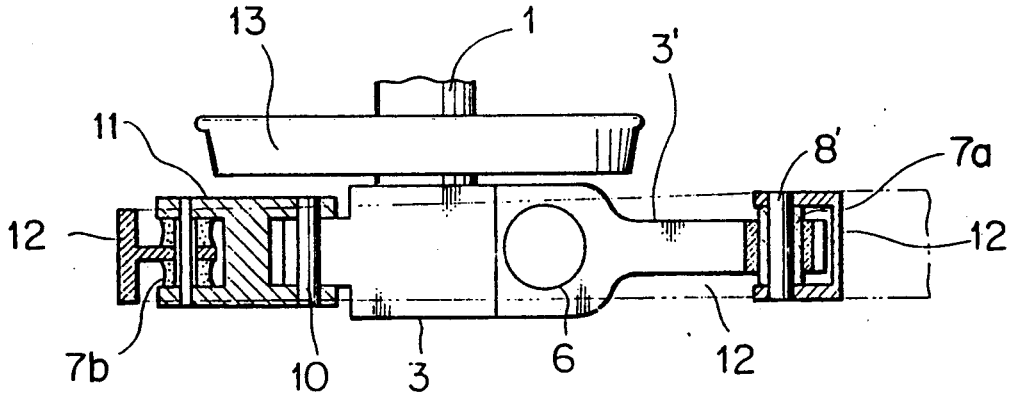
FIG. 10B PRIOR ART
Figure 11A:
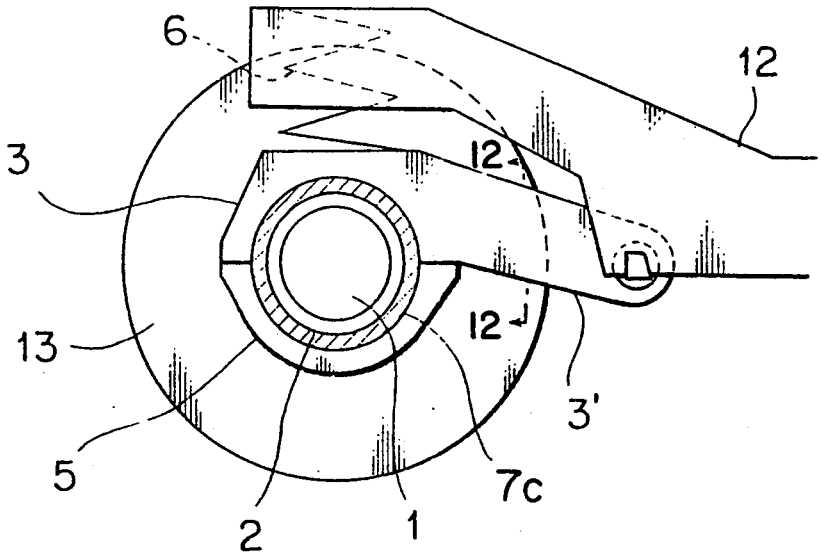
FIG. 11A PRIOR ART
Figure 11B:
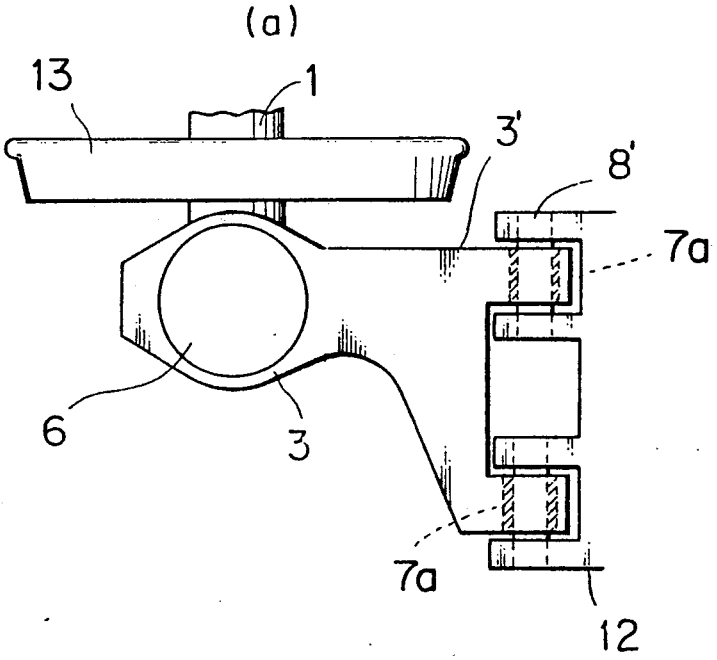
FIG. 11B PRIOR ART
Figure 12:
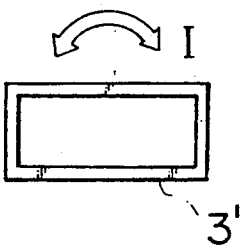
FIG. 12 PRIOR ART
FIG. 12 is a sectional view taken along the line 12—12 of FIG. 11A.

FIG. 9 shows a third embodiment of the invention. A second resilient element 9 interposed between the truck frame 12 and the axle supporting arm 3'' is employed as a single laminated set, and the other structure is the same as that of the above embodiment of FIG. 7.

ADVANTAGEOUS FEATURE OF THE PRESENT INVENTION

As has been appreciated, there is provided an axle box suspension, having an axle spring according to the present invention, wherein an axle box body is formed by providing an axle anchor rod at one end of the axle box, and the axle anchor rod is coupled to a truck frame through means of a resilient element, so that longitudinal, lateral and vertical swivel movements between the axle and the truck frame can be allowed by deforming the resilient element and the axle anchor rod without rattling movements therebetween, whereby the running stability of the vehicle is greatly improved. Furthermore, since the axle box suspension does not have slidable or slippage means, and gaps defined between the noted elements, wear and deterioration due to years of operation are effectively reduced or eliminated, whereby replacement of the components will be obviated and maintenance thereof will be much more facilitated. Moreover, excellent advantages such as simplified structure, space-saving with respect to the entire axle box suspension, and a reduction in its weight are achieved.

Obviously, many modifications and variations of the present invention are possible in light of the above teachings. It is therefore to be understood that within the scope of the appended claims, the present invention may be practiced otherwise than as specifically described herein.

What is claimed is:

1. An axle box suspension for mounting axles of a railway vehicle upon a truck frame thereof, comprising:

an axle box body including an axle box and an axle anchor rod, said axle box supporting said axle with a bearing disposed about said axle, and said axle anchor rod being integrally formed with said axle box and extending outwardly from one side thereof;

an axle spring interposed between said axle box body and said truck frame; and means for coupling said axle anchor rod to said truck frame, through means of a shaft, which is separate and distinct from said truck frame, and a resilient element disposed about said shaft, wherein said axle anchor rod has a first predetermined twisting rigidity and said resilient element has a second predetermined twisting rigidity, and wherein further said shaft has opposite axial end portions thereof fixedly mounted within said truck frame, said resilient element is fixedly mounted upon said shaft, and said axle anchor rod is fixedly mounted upon said resilient element such that no slidable movement is permitted to occur between said axle anchor rod and said resilient element, between said resilient element and said shaft, and between said shaft and said truck frame, in a running direction of said vehicle which is parallel to a longitudinal axis of said axle anchor rod, and in a direction transverse to said longitudinal axis of said anchor rod as a result of said shaft being formed with bobbin means located axially inwardly of both of said axial end portions, and said resilient element including an axially central bush section and a pair of flange sections disposed at opposite axial ends of said bush section for complementarily engaging said bobbin means of said shaft, whereby a resulting composite twisting rigidity of said vehicle with respect to said running direction thereof is less than said first predetermined twisting rigidity of said axle anchor rod or said second predetermined twisting rigidity of said resilient element.

2. An axle box suspension as claimed in claim 1, wherein the twisting rigidities of said axle anchor rod and said resilient element have to substantially the same value.

3. An axle box suspension as set forth in claim 1, wherein:

said axle spring is interposed between said axle box and said truck frame.

4. An axle box suspension as set forth in claim 1, wherein:

said axle anchor rod has a substantially H-shaped configuration as seen in cross-section so as to predetermine said first predetermined twisting rigidity thereof.

5. A suspension as set forth in claim 1, wherein:

said axle spring is interposed between said axle anchor rod and said truck frame.

6. A suspension as set forth in claim 1, wherein:

said axle anchor rod has a substantially I-shaped configuration as seen in cross-section so as to predetermine said first predetermined twisting rigidity thereof.

7. A suspension as set forth in claim 1, wherein:

said axle anchor rod has a substantially +-shaped configuration as seen in cross-section so as to predetermine said first predetermined twisting rigidity thereof.

8. A suspension as set forth in claim 1, wherein:

said suspension comprises a cantilevered type suspension of said axle box with respect to said truck frame.

9. An axle box suspension for mounting axles of a railway vehicle upon a truck frame thereof, comprising:

an axle box body including an axle box, an axle anchor rod, and a supporting arm, said axle box supporting said axle with a bearing disposed about said axle, said axle anchor rod being integrally formed with said axle box and extending outwardly from one side thereof, while said supporting arm is integrally formed with said axle box and extends outwardly from the other side thereof;

an axle spring interposed between said axle box body and said truck frame; and means for coupling said axle anchor rod to said truck frame, through means of a shaft, which is separate and distinct from said truck frame, and a first resilient element disposed about said shaft, while said supporting arm is coupled to said truck frame by means of a second resilient element interposed between said supporting arm and said truck frame, wherein said axle anchor rod has a first predetermined twisting rigidity and said first resilient element has a second predetermined twisting rigidity, and wherein further said shaft has opposite axial end portions thereof fixedly mounted within said truck frame, said first resilient element is fixedly mounted upon said shaft, and said axle anchor rod is fixedly mounted upon said first resilient member such that no slidable movement is permitted to occur between said axle anchor rod and said first resilient element, between said first resilient element and said shaft, and between said shaft and said truck frame, in a running direction of said vehicle which is parallel to a longitudinal axis of said axle anchor rod, and in a direction transverse to said longitudinal axis of said axle anchor rod as a result of said shaft being formed with bobbin means located axially inwardly of both of said axial end portions, and said first resilient element including an axially central bush section and a pair of flange sections disposed at opposite axial ends of said bush section for complementarily engaging said bobbin means of said shaft, whereby a resulting composite twisting rigidity of said vehicle with respect to said running direction thereof is less than said first predetermined twisting rigidity of said axle anchor rod or said second predetermined twisting rigidity of said first resilient element, and wherein further a third predetermined twisting rigidity of said second resilient element is substantially smaller than said composite twisting rigidity of said vehicle.

10. A suspension as set forth in claim 9, wherein:

said axle spring is interposed between said axle box and said truck frame.

11. A suspension as set forth in claim 9, wherein:

said axle spring is interposed between said axle anchor rod and said truck frame.

12. A suspension as set forth in claim 9, wherein:

said supporting arm comprises a pair of transversely spaced arm portions;

said truck frame comprises a substantially T-shaped section having a central portion thereof interposed between said pair of transversely spaced arm portions of said supporting arm; and said second resilient element comprises a pair of resilient element members disposed upon opposite sides of said central portion of said T-shaped section of said truck frame for interconnecting said central portion of said T-shaped section of said truck frame to said pair of transversely spaced arm portions of said supporting arm.

13. A suspension as set forth in claim 12, wherein:

each one of said resilient element members comprises a laminate.

14. A suspension as set forth in claim 9, wherein:

said supporting arm comprises a single arm transversely spaced with respect to said longitudinal axis of said axle anchor rod;

said truck frame comprises a substantially T-shaped section having a central portion thereof substantially aligned with said longitudinal axis of said axle anchor rod; and said second resilient element is interposed between said central portion of said T-shaped section of said truck frame and said single supporting arm for interconnecting said central portion of said T-shaped section of said truck frame to said single support arm.

15. A suspension as set forth in claim 14, wherein:

said second resilient element comprises a laminate.

16. A suspension as set forth in claim 9, wherein:

said axle anchor rod has a substantially H-shaped configuration as seen in cross-section so as to predetermine said first predetermined twisting rigidity thereof.

17. A suspension as set forth in claim 9, wherein:

said axle anchor rod has a substantially I-shaped configuration as seen in cross-section so as to predetermine said first predetermined twisting rigidity thereof.

18. A suspension as set forth in claim 9, wherein:

said axle anchor rod has a substantially +-shaped configuration as seen in cross-section so as to predetermine said first predetermined twisting rigidity thereof.

* * * * *